US006513660B2

(12) United States Patent
Bouwen

(10) Patent No.: US 6,513,660 B2
(45) Date of Patent: Feb. 4, 2003

(54) ASSEMBLY COMPRISING PACKAGING AND A CONTAINER

(75) Inventor: Theodorus Johannes Gerardus Maria Bouwen, Midwoud (NL)

(73) Assignee: Trend Merk B.V., Midwoud (NL)

( * ) Notice: Subject to any disclaimer, the term of this patent is extended or adjusted under 35 U.S.C. 154(b) by 0 days.

(21) Appl. No.: 09/770,381

(22) Filed: Jan. 29, 2001

(65) Prior Publication Data

US 2001/0025804 A1 Oct. 4, 2001

(30) Foreign Application Priority Data

Jan. 28, 2000 (NL) ..... 1014225

(51) Int. Cl.[7] ..... B65D 85/00
(52) U.S. Cl. ..... 206/525; 206/521
(58) Field of Search ..... 206/525, 385, 206/434, 459.5, 581, 736, 758, 775, 528, 539, 540, 521; 215/10, 228, 386, 12.1, 12.2, 395; 229/122.2, 125.125; 220/23.87, 23.91

(56) References Cited

U.S. PATENT DOCUMENTS 2,318,434 A 5/1943 Strauch
2,426,911 A * 9/1947 Williamson ..... 206/540
2,680,557 A 6/1954 Madden
2,810,474 A * 10/1957 Essick ..... 206/736
3,031,070 A * 4/1962 Mulder ..... 206/540
3,275,180 A * 9/1966 Optner et al. ..... 206/521
3,709,402 A * 1/1973 Templeton et al. ... 229/125.125
3,819,036 A * 6/1974 Weldon ..... 206/521
3,893,280 A * 7/1975 King ..... 206/521
4,306,653 A * 12/1981 Fales ..... 206/521
4,671,449 A * 6/1987 Fronduti ..... 206/540
5,299,700 A * 4/1994 Beniacar ..... 220/23.91
5,366,102 A * 11/1994 Bergner et al. ..... 206/459.5
5,673,796 A * 10/1997 Tulloch ..... 206/459.5

* cited by examiner

*Primary Examiner*—Luan K. Bui
(74) *Attorney, Agent, or Firm*—Young & Thompson

(57) ABSTRACT

A packaging includes a body with a sleeve portion. The sleeve portion is essentially of rectangular construction and has a fold-back lid at one end and is provided with an opening at the other end. The packaging does not have a base. The packaging is part of an assembly that also includes a container to be accommodated within the packaging. The dimensions of the container and the packaging are matched to one another in such a way that mutual engagement takes place.

10 Claims, 1 Drawing Sheet

ASSEMBLY COMPRISING PACKAGING AND A CONTAINER

BACKGROUND OF THE INVENTION

The present invention relates to an assembly comprising a container and packaging for the latter, which packaging comprises a box-like body with a sleeve-like portion which envelops the article and has two ends, one end being provided with a closure.

A assembly of this type is disclosed in U.S. Pat. No. 2,318,434 A. With this assembly the neck portion of a container such as a bottle is covered by a sleeve. This sleeve functions to cover the closure, such as a cap.

In general, packaging or outer packaging that is closed all round is known for packing containers of a wide variety of types, such as bottles, flasks and the like. Such an outer packaging functions to protect the contents placed therein, provides an opportunity for the incorporation of promotional and/or informative text and in some cases has an effect on the power to generate willingness to buy.

After all, for some applications, such as in cosmetics, a certain degree of curiosity with regard to the contents of the packaging is generated in the consumer and it has been found that the use of packaging stimulates an incentive to buy.

Moreover, packaging can be used to give non-uniform containers a uniform appearance on the shelf as a result of the packaging, It has been found that especially in the case of cosmetic products the consumer's "curiosity" leads to such packaging being opened in order to see the contents. Before a product is bought it is looked at a number of times by various consumers. That is to say, the packaging is accordingly opened and closed again a number of times by consumers.

It has been found that this results in damage to an appreciable percentage, typically 20%, of the packs. If a consumer is able to choose from a number of identical products he/she will always choose the product with the undamaged packaging. In other words, damaged packaging containing product is particularly difficult to sell and in practice will be returned to the manufacturer.

The latter will repack the product. The costs associated with such an action are appreciable.

Moreover, the use of such "outer packaging" is associated with an appreciable material requirement, which is in conflict with the requirements imposed by various government agencies with regard to reduced use of packaging material.

U.S. Pat. No. 2,680,557 A discloses a packaging for ice cream filled waffles which is open at the top. For ease of eating, this packaging extends around the ice cream product concerned. With this product two waffles are held in the horizontal position some distance apart and the space between them can be filled with ice cream.

SUMMARY OF THE INVENTION

The aim of the present invention is so to optimise the packaging described above that such disadvantages do not arise.

This aim is achieved with a assembly as described above in that the other end of the packaging has an opening, the limits of which correspond to said container and the packaging being designed at least partially to contain said container in the sleeve-like portion.

According to the invention the packaging is constructed without a base. That is to say, introduction of the product can easily take place through the opening in the sleeve-like portion. This means that packing during the production of the assembly consisting of packaging and container is appreciably simplified. This applies equally to putting the container back in the packaging.

Because of the presence of the opening, the closure at the "top" of the packaging can, in principle, be non-opening. According to an advantageous embodiment, however, said closure consists of a fold-back lid of the type conventional in the state of the art. After opening the lid the container that has been placed therein can either be pushed out downwards via the opening at the bottom or can be removed from the packaging in the conventional way. Because of the presence of an opening it is important, according to an advantageous embodiment of the invention, that container and sleeve-like portion are in clamping engagement with one another. This applies in particular if the cross-sectional shape of the container does not match the cross-sectional shape of the packaging at every point. That is to say, where there is a possibility that the user grasps the packaging without in so doing directly grasping the container it is necessary that the container is joined to the packaging in some other way, such as by frictional engagement. Of course, engagement with the aid of a readily releasable adhesive or the like is also possible.

The sleeve-like portion can have any shape known in the state of the art. According to an advantageous embodiment this shape is essentially of the parallelepiped type. This applies in particular in the case of an embodiment with a fold-back lid. The shape of the container can differ from the shape of the sleeve-like portion, as indicated above with regard to the shape of the container in the longitudinal direction, but this can also relate to the cross-sectional shape, Preferably, however, the outer periphery of the container is essentially identical to the inner periphery of the sleeve-like portion at at least one point, as a result of which optimum engagement is provided.

According to an advantageous embodiment of the invention the packaging extends over the entire height of the container. That is to say, when the container is placed on a shelf together with the packaging no part of the container is visible. The bottom of the container is in direct contact with the shelf. After all, the packaging does not extend further than the bottom.

The invention also relates to a assembly consisting of a container and the packaging described above where there is frictional engagement between these two components.

As indicated, the container can be of any construction known in the state of the art. The packaging can, of course, be provided with some printing or other indication that can be either for promotional or information purposes.

BRIEF DESCRIPTION OF THE DRAWINGS

One embodiment of the invention will be explained in more detail below with reference to an illustrative embodiment shown in the drawing. In the drawing.

DETAILED DESCRIPTION OF THE PREFERRED EMBODIMENTS

Figure 1:
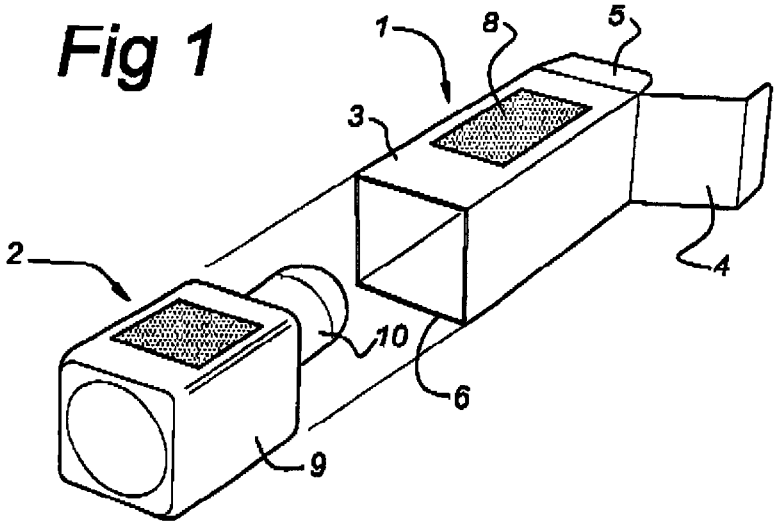
FIG. 1 shows a diagrammatic, perspective view of the packaging and container according to the invention.

The packaging according to the invention is indicated by 1 in the figures. This packaging can be made of any material known in the prior art, such as cardboard material. The packaging consists of a box-like or parallelepiped-shaped body. This body consists of a sleeve-shaped portion 3 that in the illustrative embodiment in question is of rectangular shape and includes promotional and/or informative text 8. It must be understood that any other shape can be made, such as polygonal, elliptical and the like. The sleeve-like portion 3 is provided close to one end with a lid portion 4 and two flaps 5. By this means closure can be achieved in the conventional manner.

In contrast to the prior art, the packaging is not provided with a base close to the other end, that is to say the "bottom" when in use. Instead of this there is an opening 6 which is delimited by the sides of the sleeve-like portion 3.

A container is indicated by 2. In the illustrative embodiment shown, this container consists of a glass bottle 9 with a screw cap 10. It will be understood that any other type of container of any desired shape and made from any desired material can be used for the invention.

Figure 2:
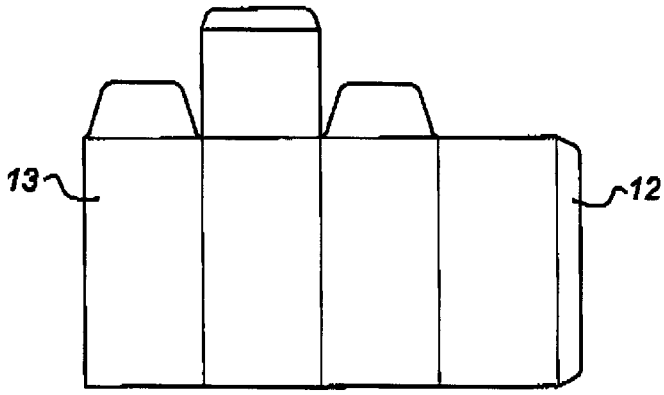
FIG. 2 shows the blank from which the packaging according to the present invention has been produced.

FIG. 2 shows the blank, from which packaging 1 is produced, in the opened-out state. The edges 12 and 13 form the end limits and are fixed to one another very accurately during production. By this means the inner periphery of the sleeve-like portion 3 is accurately defined.

Figure 3:
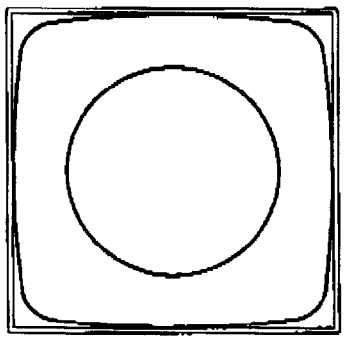
FIG. 3 shows a cross-section of the packaging and container when the packaging and container have been fully fitted together.

This is important, as can be seen from FIG. 3. After all, according to a variant embodiment of the invention there is engagement of the sleeve-like portion 3 on the outside wall of the bottle 9. With this arrangement appreciable requirements are imposed on the tolerance of both the packaging and the bottle. As a result it is possible to grasp the packaging at a point where there is no direct contact with bottle 9, for instance in the upper region of the packaging 1.

In the use position the height of the packaging at least corresponds to the height of the article to be packed. That is to say, on placing on a shelf the bottom of the article, such as a bottle, will come into direct contact with the surface of the shelf, but will not be visible because the packaging surrounds the remainder of the article, such as a container, on all sides. Of course, openings can be made in the packaging.

It will be understood that various products, that is to say bottles, for example, of different dimensions, colours and the like can be packed using a uniform packaging. This results in an appearance on the shelf that is easy on the eye and promotes sales, whilst adequate information with regard to the contents can immediately be imparted to the user when the bottles or other container are taken out.

It can be seen from the figures that when it has been fitted the packaging essentially covers the container. The packaging according to the invention thus differs from previously known constructions, also termed "skirt construction". The latter consisted solely of a sleeve-like portion that was fitted around the container. According to the invention the sleeve-like portion is provided with a top closure.

According to the invention it is only possible to construct the packaging in such a way that the container stands on its bottom, that is to say there is minimal clearance between the free peripheral edge of the sleeve-like portion 3 and the bottom of bottle 9.

After reading the above description variants will be immediately apparent to those skilled in the art, winch variants are obvious and fall within the scope of the appended claims.

What is claimed is:

1. An assembly comprising a container and packaging for the container, said container comprising an outer wall having an open top and a removable cap for covering said open top, said packaging comprising a body with a sleeve portion that envelops the container and has two ends, one end being provided with a selectively reopenable closure, and an other end of said packaging being open, said packaging at least partially containing said container within the sleeve portion, wherein said sleeve portion of said packaging and said outer wall of said container are in direct clamping engagement to ensure a tight fit.

2. The assembly according to claim 1, wherein at a certain height on said sleeve portion, said packaging and said container are in clamping engagement around essentially an entire periphery of said container.

3. The assembly according to claim 1, wherein said selectively reopenable closure of said packaging is directly adjacent to said cap.

4. The assembly according to claim 1, wherein the packaging is cardboard material.

5. The assembly according to claim 1, wherein said sleeve portion is essentially parallelepiped.

6. The assembly according to claim 1, wherein said selectively reopenable closure comprises a fold-back lid.

7. The assembly according to claim 1, wherein said packaging surrounds said container except at a face of said packaging having said opening.

8. The assembly according to claim 1, wherein a cross-sectional area of said opening corresponds to a maximum cross-sectional area of the container.

9. An assembly comprising a container and a packaging for the container, said packaging comprising a body with a sleeve portion that envelops the container, and first and second ends, said first end having a selectively reopenable closure, said second end being open, said container comprising an outer wall having a sealed end and an openable end, said outer wall frictionally engaging said sleeve portion, said openable end having a removable cap for covering said openable end, said sealed end being adjacent said second end and said openable end being adjacent said first end.

10. An assembly comprising a container and a packaging for the container, said container comprising an outer wall having a closed end and an openable end, said openable end having a removable cap for covering said openable end, said packaging comprising a body movable from a first position to a second position for enclosing said container and having first and second ends, said first end having a selectively reopenable closure, said second end being open, wherein when in said first position, said second end being adjacent said openable end of said container to allow access to said container, and when in said second position, said packaging being frictionally engageable with said outer wall of said container and said second end being adjacent said closed end.

* * * * *